US010183770B2

(12) United States Patent
Collins et al.

(10) Patent No.: US 10,183,770 B2
(45) Date of Patent: Jan. 22, 2019

(54) PROCESS FOR PRODUCING A PACK OF SMOKING ARTICLES

(71) Applicant: JT International S.A., Geneva (CH)

(72) Inventors: Tim Collins, Surrey (GB); Paul Mewha, Igel (DE); Jürgen Kümpel, Konz (DE)

(73) Assignee: JT International S.A. (CH)

( * ) Notice: Subject to any disclaimer, the term of this patent is extended or adjusted under 35 U.S.C. 154(b) by 735 days.

(21) Appl. No.: 14/712,494

(22) Filed: May 14, 2015

(65) Prior Publication Data

US 2015/0329227 A1 Nov. 19, 2015

(30) Foreign Application Priority Data

May 16, 2014 (EP) ..... 14168657

(51) Int. Cl.
*B65B 19/22* (2006.01)
*B65B 51/04* (2006.01)
(Continued)

(52) U.S. Cl.
CPC ..... *B65B 19/22* (2013.01); *A24F 15/00* (2013.01); *B65B 19/228* (2013.01); *B65B 51/04* (2013.01);
(Continued)

(58) Field of Classification Search
CPC ..... B65B 19/22; B65B 61/18; B65B 19/228; B65B 51/04; B65D 85/10; B65D 85/1045; B65D 2313/04; A24F 15/00; B65C 1/02
(Continued)

(56) References Cited

U.S. PATENT DOCUMENTS 2,784,757 A * 3/1957 Bosca ..... A45C 13/1069 150/138
3,749,301 A * 7/1973 Peckar ..... B65D 5/6673 220/315
(Continued)

FOREIGN PATENT DOCUMENTS

EP 1 033 317 A2 9/2000
EP 1 683 736 A2 7/2006
(Continued)

OTHER PUBLICATIONS

Extended European Search Report for Application No. 14168657.6, dated Nov. 4, 2014 (5 pages).
(Continued)

*Primary Examiner* — Alexander M Valvis
*Assistant Examiner* — Lucas E. A. Palmer
(74) *Attorney, Agent, or Firm* — Lerner, David, Littenberg, Krumholz & Mentlik, LLP

(57) ABSTRACT

The invention provides a process for producing a pack of smoking articles, such as cigarettes, which comprises: assembling packaging material, such as a packaging blank, around a charge of smoking articles to form a pack enclosing the charge smoking articles. The assembled pack includes a container portion to hold the charge of smoking articles, a lid in hinged connection with the container portion which is movable between a closed position for preventing access to the smoking articles in the container portion and an open position for accessing the smoking articles, and a magnetic closure having a first magnetic closure element and a second magnetic closure element which are configured and arranged to exert a magnetic force for holding the lid in the closed position. The process for producing the pack includes placing the first and second magnetic closure elements together
(Continued)

or in combination with one another in the packaging material that forms the pack.

20 Claims, 4 Drawing Sheets

(51) Int. Cl.
*B65C 1/02* (2006.01)
*A24F 15/00* (2006.01)
*B65B 61/18* (2006.01)
*B65D 85/10* (2006.01)

(52) U.S. Cl.
CPC ..... *B65B 61/18* (2013.01); *B65C 1/02* (2013.01); *B65D 85/1045* (2013.01); *B65D 2313/04* (2013.01)

(58) Field of Classification Search
USPC ..... 53/416
See application file for complete search history.

(56) References Cited

U.S. PATENT DOCUMENTS 4,559,757 A * 12/1985 Focke ..... B65B 19/225 198/478.1
4,681,496 A * 7/1987 Fasolino ..... F16B 19/05 411/361
4,753,384 A * 6/1988 Focke ..... B65B 19/20 206/271
4,947,617 A * 8/1990 Focke ..... B65B 11/004 53/202
5,822,948 A * 10/1998 Manservigi ..... B65B 11/30 52/466
5,979,140 A * 11/1999 Focke ..... B65B 19/245 53/234
6,167,597 B1 1/2001 Malin
6,470,651 B1 * 10/2002 Polazzi ..... B65B 19/225 493/910
6,729,105 B2 * 5/2004 Spatafora ..... B65B 19/221 53/376.5
7,563,221 B2 * 7/2009 Polloni ..... B65B 19/223 53/148
8,387,788 B2 3/2013 Nakano et al.
2003/0038044 A1 * 2/2003 Draghetti ..... B65D 85/1081 206/273
2004/0256254 A1 * 12/2004 Draghetti ..... B65D 85/1045 206/259
2007/0193895 A1 * 8/2007 Weiss ..... A24F 15/12 206/259
2009/0159472 A1 * 6/2009 Bardet ..... B65D 85/1045 206/256
2011/0042248 A1 * 2/2011 Chatelain ..... B65D 5/38 206/267
2011/0118098 A1 * 5/2011 Harms ..... B05C 5/0279 493/2
2011/0258965 A1 * 10/2011 Gassner ..... B65G 47/1471 53/307
2013/0193011 A1 * 8/2013 Scanlan ..... B65D 85/18 206/281
2014/0124395 A1 * 5/2014 Nadeau ..... B65D 5/5213 206/250
2015/0305402 A1 * 10/2015 Bourgoin ..... B65D 5/6691 206/265
2015/0336696 A1 * 11/2015 Cavazza ..... B65B 19/20 53/456
2016/0009483 A1 * 1/2016 Hodges ..... B65D 71/06 206/271
2016/0130074 A1 * 5/2016 Kastha ..... B65D 5/6688 206/245

FOREIGN PATENT DOCUMENTS

EP 2 233 407 A1 9/2010
FR 1529783 A 6/1968
JP 2000-255597 A 9/2000
JP 52-41035 B2 7/2013
JP 2013-544720 A 12/2013
WO 2011/097650 A2 8/2011
WO 2012/057961 A2 5/2012
WO 2015/115096 A1 8/2015

OTHER PUBLICATIONS

Japanese Office Action for Application No. 2015-099917, dated Jul. 25, 2016 (10 Pages).

* cited by examiner

PROCESS FOR PRODUCING A PACK OF SMOKING ARTICLES

The present invention concerns a process for producing packs of consumer goods, and in particular smoking articles, such as cigarettes, cigarillos, cigars, and the like. For the sake of brevity and clarity, such items will be simply referred to herein as "smoking articles". This invention also concerns an associated system for producing packs of smoking articles, and the packs of smoking articles so produced.

Conventional cigarette packs typically include a generally cuboid, flip-top box comprised of a semi-rigid material, such as card, paperboard, or a similar material, forming an outer shell containing a charge of cigarettes and typically having a hinged lid, which a user operates for access to the smoking articles. The flip-top box-type pack format allows for good protection of the smoking articles. After opening, and during the life of the pack, however, the quality of the closure achieved with the hinged lid may suffer, especially if the outer shell of the pack is subjected to excessive loads, which may deform the shape of the box.

For these reasons, the applicant has directed its attention to the task of providing a new and improved pack of smoking articles and an associated production process for producing such a pack. The present invention particularly concerns the use of a magnetic closure in a pack of smoking articles (e.g. cigarettes) which ensures a reliable and high quality closure of the pack sustaining mechanical constraints, preserving the shape of the pack throughout its life, and which may also inhibit an inadvertent or unwanted opening of the pack. Further, the present invention concerns a production process which enables such a magnetic closure to be incorporated in a pack of smoking articles in a reliable, highly repeatable and automated manner. An object of the invention is therefore to provide a new and improved process for producing packs of smoking articles. Another object of the invention is to provide a new and improved pack of smoking articles.

In accordance with this invention, a process is provided for producing a pack of smoking articles having the features set out in claim 1. Various advantageous or preferred features of the invention are recited in the dependent claims.

According to one aspect, therefore, the invention provides a production process for producing a pack of smoking articles, the process comprising:

- assembling packaging material, including a packaging blank, around a charge of smoking articles to form a pack enclosing the charge of smoking articles,
- wherein the assembled pack comprises a container portion for holding the charge of smoking articles, a lid that is movable between a closed position preventing access to the smoking articles in the container portion and an open position for accessing the smoking articles, and a magnetic closure having a first magnetic closure element and a second magnetic closure element which are configured and arranged to exert a magnetic force for holding the lid in the closed position, and
- wherein the process includes placing or introducing the first and second magnetic closure elements together or in combination with one another in the packaging material that forms the pack, typically in an automated application step or procedure. Expressed in another way, the process includes the step of introducing the second magnetic closure element into or onto the packaging material forming the pack by combining that second magnetic closure element with the first magnetic closure element.

Accordingly, the invention provides a production process with which a magnetic closure can be provided in a pack of smoking articles on an automated basis, either integrated within or compatible with a high-speed packaging procedure. The first and second magnetic closure elements are placed in a combined state in the packaging material; i.e. such that they are combined with one another or attached to one another. In this regard, the magnetic closure elements are typically held together or in a combined state in the packaging material by a magnetic force of attraction acting between those elements. In other words, the process of the invention utilises the magnetic attraction between the first and second magnetic closure elements to localise and to hold temporarily one of the closure elements with respect to the other as the pack of smoking articles is produced and the closure elements themselves are incorporated into the pack. As the process of the invention is typically automated, it is typically carried out in a repetitious manner for producing a plurality of packs of smoking articles via an automated system.

In a preferred embodiment, the process comprises introducing these first and second magnetic closure elements into the packaging material of the pack together or combined with one another. Thus, in this embodiment, a single operation may be employed to introduce both of the magnetic closure elements simultaneously into the packaging material. That is, both closure elements can be introduced into or onto the packaging material in a single step or operation, with the magnetic closure elements held together by magnetic force.

In a preferred embodiment, therefore, the invention provides a production process for producing packs of smoking articles, comprising:

- assembling packaging material such as a packaging blank around a charge of smoking articles, for example by folding and/or by bonding the blank, to form a pack enclosing the charge of smoking articles;
- wherein the assembled pack comprises a container portion for holding the charge of smoking articles, a lid that is movable between a closed position preventing access to the smoking articles in the container portion and an open position for accessing the smoking articles, and a magnetic closure having a first magnetic closure element and a second magnetic closure element which are configured and arranged to exert a magnetic force for holding the lid in the closed position;
- wherein the process includes separately or independently affixing or attaching each of the first and second magnetic closure elements to the packaging material of the pack while the magnetic closure elements are in a combined state.

That is, the first and second magnetic closure elements may be individually affixed or attached to the packaging material of the pack (e.g. by bonding) while they are held together or in combination with one another. In this way, the invention provides a production process with which a magnetic closure can be provided in a pack of smoking articles on an automated basis, integrated within a high-speed packaging procedure.

Specifically, the first and second magnetic closure elements are independently fixed or attached to the packaging material of the pack in a combined state. Thus, the magnetic closure elements can desirably be affixed or attached to the packaging material in a single operation.

In a particularly preferred embodiment, the step of affixing or attaching each of the first and second magnetic closure elements to the packaging material comprises independently bonding or adhering each of the magnetic closure elements to the packaging material substantially simultaneously. In this regard, the process desirably comprises providing each of the first and second magnetic closure elements on a substrate, e.g. a carrier substrate or label, and bonding or adhering the substrate to the packaging material. The substrate may be a common substrate, i.e. common to or shared by the first and second magnetic closure elements, and the step of bonding or adhering the substrate to the packaging material may take place in a single operation. Thus, the substrate or label may be an adhesive label, or adhesive may be applied separately. Alternatively, an adhesive (such as a liquid adhesive) may be applied to the packaging material at a position for affixing or bonding each respective closure element, and/or it may be applied to the respective closure element itself. A bonding strength of the bond fixing each magnetic closure element to the packaging material is preferably greater than the maximum magnetic force capable of being exerted between the magnetic closure elements.

In an alternative preferred embodiment, the process comprises introducing the first magnetic closure element into or onto the packaging material in a first step or operation, then subsequently placing the second magnetic closure element onto the first magnetic closure element applied to the packaging material previously. In this manner, the first and second magnetic closure elements are introduced into or onto the packaging material such that they assume a combined state, with the second magnetic closure element placed onto and held by magnetic attraction to the first magnetic closure element. Thus, the second magnetic closure element is introduced into or onto the packaging material by placing it in combination with the first magnetic closure element already introduced or applied to the packaging material.

Although the first and second magnetic closure elements may be temporarily held together or attached to one another by a force of magnetic attraction in the packaging material, the process of the invention nevertheless provides that the first and second magnetic closure elements are respectively affixed or bonded to different parts of the packaging material. In particular, one of the first and second magnetic closure elements may be affixed or bonded to a part of the packaging material that forms the lid of the pack, and the other of the magnetic closure elements is preferably affixed or bonded to a part of the packaging material that forms the container portion of the pack. Thus, the process preferably includes the step of affixing or bonding the second magnetic closure element to the packaging material as it is magnetically held together or combined with the first magnetic closure element. When production of the pack is finished, the first and second magnetic closure elements are desirably positioned in or on the packaging material such that they substantially align with and/or contact one another when the lid is in the closed position.

In a particularly preferred embodiment, at least one of the first and second magnetic closure elements of the magnetic closure is a permanent magnet. In this regard, the permanent magnet may, for example, comprise a rare earth magnet, such as a neodymium magnet. Alternatively, the permanent magnet may comprise a layered magnetic material such as disclosed in EP 1 360 071 B1 directly extruded to the packaging material or in the form of a self-adhesive tape commercially available from manufacturers such as 3M or AMF magnetics. Because the packaging material is typically formed of a semi-rigid sheet material, such as card or paperboard, with a thickness typically within the range of about 0.1 mm to about 1 mm, the permanent magnet preferably will also have a thickness in this range; e.g. about 0.5 mm. This enables the magnetic closure element to be introduced and/or incorporated into or onto the packaging material in a relatively unobtrusive manner. Each of the magnetic closure elements preferably presents a surface area in the range of about 50 $mm^2$ to 200 $mm^2$; e.g. about 75 $mm^2$. For example, the permanent magnet may be provided as a circular or disc-shaped element having a diameter of about 10 mm. While both of the first and second magnetic closure elements may comprise a permanent magnet, it is preferred that one of the first and second magnetic closure elements is not itself a magnet but rather is comprised of material, such as a ferrous material, that reacts to a magnetic field generated by the permanent magnet of the other magnetic closure element. In this way, the element of magnetically sensitive (e.g. ferrous) material may not be prone to interact in an undesired manner with the ferrous metal (e.g. steel) of the packaging machinery used in the process of producing the packs of smoking articles.

In a preferred embodiment, the packaging blank of semi-rigid material has a substantially flat or planar form in a non-assembled (i.e. blank) state. During the assembling step, the blank is typically folded to form the pack having a generally cuboid shape, as is known in the art. The lid of the pack is typically pivotally movable between the closed and open positions via a hinge-type connection. The material of the blank is preferably a semi-rigid sheet material, such as card, stiffened paper, paperboard, fibreboard, polymer sheet material, or the like. Although the semi-rigid material may be relatively flexible, regardless of its composition it will nevertheless usually be dimensionally stable in order to impart structural stability to the pack of smoking articles, and thereby protect the packaging and the smoking articles from damage (e.g. inadvertent compression or crushing) during transport and storage.

In a preferred embodiment, the first and second magnetic closure elements are introduced into the packaging material prior to the step of assembling or folding the packaging blank around the charge of smoking articles to form the pack. In this regard, the magnetic closure elements may be placed or introduced into or onto the packaging blank prior to the step of assembling the blank around the charge of smoking articles. For example, a preliminary operation in preparing the blank may include a step of fixing or bonding one of the magnetic closure elements thereto. That one of the first and second magnetic closure elements affixed or bonded to the blank is preferably positioned on a part of the blank that forms the lid of the pack, especially an inner face of the lid or an edge region of the lid. The other magnetic closure element may then be placed and held in combination therewith by a force of magnetic attraction. Thus, the packaging blanks supplied to or delivered by the packaging machinery in the production process may optionally include the first and second magnetic closure elements (e.g. a permanent magnet and a magnetically sensitive element) pre-applied to them. As an alternative, however, the packaging blanks supplied for use in the process may include just the first magnetic closure element and the second magnetic closure element may be placed onto the first magnetic closure element prior to assembling or folding the packaging blank around the charge of smoking articles to form the pack.

In a preferred embodiment, the packaging material includes an inner frame (e.g. of card or paper) that is wrapped or folded around the charge of smoking articles prior to a step of combining the charge of smoking articles with the packaging blank to be assembled or folded into the pack. Thus, in this embodiment, the magnetic closure elements may be applied or introduced into or onto the inner frame, and preferably at a position which lies opposite an inner face of the lid or opposite an edge region of the lid in the assembled pack. As before, a preliminary operation in preparation of the frame may include applying or fixing one of the magnetic closure elements to it. Indeed, all of the inner frames used in the production process may include one of the first and second magnetic closure elements pre-applied or bonded to them, with the other closure element then placed and held in combination therewith.

In an alternative embodiment of the invention, the first and second magnetic closure elements are introduced into or onto the packaging material that forms the pack after the step of assembling or folding the packaging blank around the charge of smoking articles. In this regard, the process may comprise opening the pack after its assembly and introducing, applying, and/or inserting the first and second magnetic closure elements into or onto a part of the container portion and/or lid. This step is automated, and may preferably be carried out via a stand-alone device comprising means for opening and closing the lid of the pack and a pick-and-place device for a repeatable and precise placement and application of the magnetic closure elements. After the step of opening the pack (i.e. a lid of the pack), the first and second closure elements may be introduced together and then substantially simultaneously affixed or bonded to the lid and the container portion of the pack. In this regard, the process typically includes again closing the pack, e.g. before wrapping the pack with a barrier film.

As noted above, one of the first and second magnetic closure elements is preferably affixed or bonded to a part of the packaging material that forms the lid of the pack and the other of the magnetic closure elements is preferably affixed or bonded to a part of the packaging material that forms the container portion of the pack. Regardless of whether they are introduced into or onto the packaging material before or after the step of assembling the blank, therefore, the first and second magnetic closure elements are located to interact between the movable lid and the container portion of the pack. In this way, the magnetic closure can desirably give a user a felt sense of a secure closure as he/she handles the lid and/or an aural sense of a secure closure via a "click" sound as the first and second magnetic closure elements make contact when the lid moves into the closed position.

In a preferred embodiment of the invention, each of the first and second magnetic closure elements is respectively bonded to the packaging material, e.g. adhesively bonded. In this regard, a bonding strength of the bond fixing the magnetic closure elements to the packaging material is greater than a maximum magnetic force that is capable of being exerted by or between the magnetic closure elements.

In a particularly preferred embodiment, either or both of the first and second magnetic closure elements may be affixed or bonded to the packaging material via a carrier substrate, such as a label, which is adhered or bonded to the packaging material. In this regard, the label may be an adhesive label or adhesive may be applied separately. As an alternative, a liquid adhesive may be applied to the packaging material at a position for affixing or bonding a respective closure element or to the respective closure element itself.

In a preferred embodiment of the invention, either or both of the first and second magnetic closure elements may be received and accommodated in a respective recess provided in the packaging material. In this regard, a respective recess may be provided in a part of the packaging blank, in the lid, in the container portion, and/or in the frame for receiving and accommodating the magnetic closure elements.

In a particularly preferred embodiment of the invention, the process further comprises wrapping the smoking article pack in a flexible barrier film. In this context, it will be noted that the magnetic closure elements are introduced into the packaging material which forms the pack prior to wrapping the pack in the flexible barrier film. The process of the invention is intended to be carried out repetitiously and is thus for producing a plurality of packs of smoking articles, e.g. via an automated system.

According to another aspect, the invention provides a process for producing a pack of smoking articles, comprising:

- assembling packaging material, including a packaging blank around a charge of smoking articles to form a pack enclosing the charge of smoking articles,
- wherein the assembled pack comprises a container portion for holding the charge of smoking articles, a lid which is movable between a closed position for preventing access to the smoking articles in the container portion and an open position to access the smoking articles, and a magnetic closure including a first magnetic closure element and a second magnetic closure element which are configured and arranged to exert a magnetic force, one upon the other, for holding the lid in the closed position;
- wherein the process includes affixing or bonding the second magnetic closure element to the packaging material as or while it is held together or in a combined state with the first magnetic closure element.

In preferred embodiment, the step of affixing or bonding the second magnetic closure elements to the packaging material while together or in a combined state with the first magnetic closure element includes providing the second closure element on a substrate or label, and then bonding or adhering that substrate or label to the packaging material.

As already noted above, the first and second magnetic closure elements are located in the assembled pack to substantially align with and/or to contact one another when the lid is in the closed position. With one of the magnetic closure elements incorporated in a part of the lid and the other magnetic closure element in a part of the container portion directly opposite or adjacent the lid, a magnetic force of attraction exerted by one of the magnetic closure elements upon the other acts to hold the lid in the closed position. Furthermore, as already noted, at least one of the first and second magnetic closure elements is preferably a permanent magnet, while the other may be of a magnetically sensitive material, such as a ferrous metal.

According to a further aspect, the present invention provides a pack of smoking articles, comprising:

- a container portion defining a cavity to hold a charge of the smoking articles,
- a lid which is movable between a closed position which prevents access to the smoking articles in the container portion and an open position to access the smoking articles, and
- a magnetic closure with a first magnetic closure element and second magnetic closure element which are configured and arranged to exert a magnetic force, one with respect to the other, for holding the lid in the closed position.

In a particularly preferred embodiment, the first and second magnetic closure elements are positioned to substantially align with and/or to contact one another when the lid is in the closed position; for example, at an edge region or a face of the lid and in the container portion. In this regard, the first magnetic closure element is preferably provided in or on the lid of the pack, especially at a front inner face of the lid or at an edge region of the lid. The second magnetic closure element, on the other hand, is preferably provided in or on the container portion at a position directly opposite or adjacent to the first magnetic closure element. In this way, a magnetic force of attraction exerted by one of the magnetic closure elements upon the other acts to hold the lid in the closed position.

In a particularly preferred embodiment, the first and second magnetic closure elements are received and accommodated in a respective recess provided in the packaging material of the pack. In this regard, a recess may be provided in part (e.g. an edge region or a face) of the lid and/or in the container portion to receive and accommodate a respective one of the magnetic closure elements.

In a particularly preferred embodiment, the first and second magnetic closure elements are bonded, e.g. adhesively bonded, to the lid and/or container portion of the pack. A bonding strength of the bond fixing the magnetic closure elements to the pack is designed to be greater than a maximum magnetic force exerted by the magnetic closure elements. Preferably, the first and second magnetic closure elements are applied to the lid and/or container portion of the pack via a carrier substrate, such as a label, which is adhered or bonded to the packaging material. In this regard, the label is preferably an adhesive label or adhesive may be applied separately.

For a more complete understanding of the invention and the advantages thereof, exemplary embodiments of the invention are explained in more detail in the following description with reference to the accompanying drawing figures, in which like reference characters designate like parts and in which.

Figure 1A:
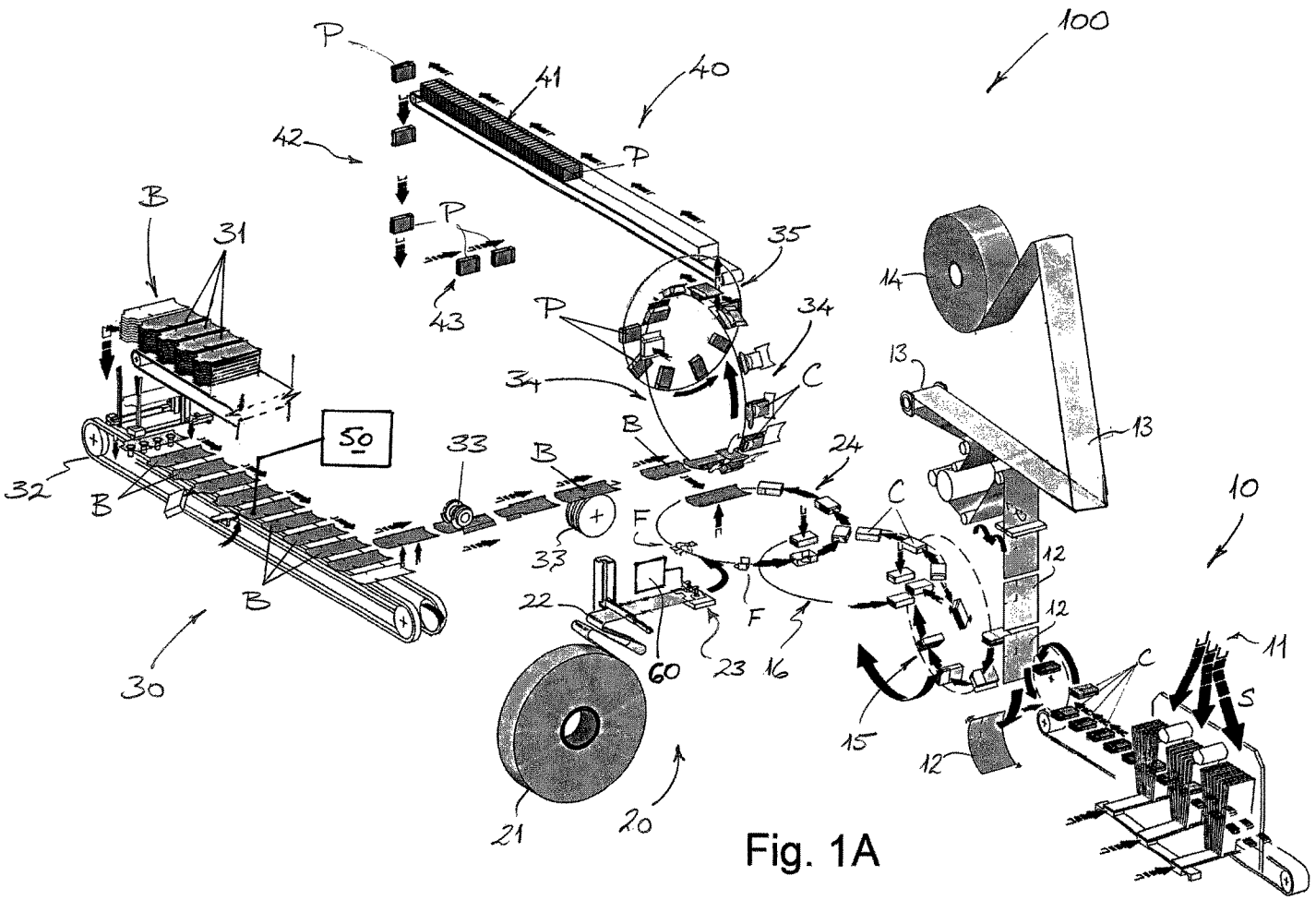
FIG. 1A is a schematic perspective view of a packaging system for use in carrying out a process for producing a pack of smoking articles according to an embodiment of this invention.

The accompanying drawings are included to provide a further understanding of the present invention and are incorporated in and constitute a part of this specification. The drawings illustrate particular embodiments of the invention and together with the description serve to explain the principles of the invention. Other embodiments of the invention and many of the attendant advantages of the invention will be readily appreciated as they become better understood with reference to the following detailed description.

It will be appreciated that common and/or well understood elements that may be useful or necessary in a commercially feasible embodiment are not necessarily depicted in order to facilitate a more abstracted view of the embodiments. The elements of the drawings are not necessarily illustrated to scale relative to each other. It will further be appreciated that certain actions and/or steps in an embodiment of a method may be described or depicted in a particular order of occurrences while those skilled in the art will understand that such specificity with respect to sequence is not actually required. It will also be understood that the terms and expressions used in the present specification have the ordinary meaning as is accorded to such terms and expressions with respect to their corresponding respective areas of inquiry and study, except where specific meanings have otherwise been set forth herein.

Referring firstly to FIG. 1 of the drawings, a system 100 for packaging smoking articles S, especially cigarettes, is shown schematically. Such a system 100 can, for example, be based (as represented herein) on a commercially available X3 packer system from Italian manufacturer G.D. S.p.A. The system 100 is readily employed in or adapted to a process for producing packs P of cigarettes S according to a preferred embodiment. This process is highly automated and may, for example, produce the packs P at a rate in the range of 50 to 500 packs per minute, or more.

The packaging system 100 includes a number of subsystems 10, 20, 30, 40 which are directed performing specific operations in the overall packaging procedure. In this regard, the subs-system 10 performs the function of collecting a plurality of the cigarettes S from a buffer or hopper 11 and sorting these into individual groups or charges C of cigarettes, each of which is intended to fill an individual pack P. Thus, each charge C typically comprises a group or collation of e.g. 20 cigarettes sorted and arranged in three rows or layers of seven, six, and seven cigarettes, respectively. As will be understood, however, the number of rows and/or the number cigarettes S in each row may vary depending on the design of the pack P. In this sub-system 10, a first packaging material, typically in the form of a foil or paper, is provided in rectangular sheets 12 that are severed from a continuous web 13 drawn from a roll 14. These rectangular sheets 12 of foil or paper are then wrapped around the individual groups or charges C of cigarettes S as they are transported around a carousel 15. In this way, the wrapped sheet 12 serves to consolidate and hold each charge C in a desired configuration, while protecting the cigarettes S from outward influences and helping to retain the freshness of the tobacco they contain. The wrapped charges C of smoking articles or cigarettes S are conveyed from the carousel 15 to a further carousel 16 for delivery to the next sub-system 20.

The sub-system 20 includes a roll 21 of a second packaging material, such as flexible card, stiffened paper or the like, which is drawn from the roll 21 in a continuous web 22 and conveyed to a cutting station 23. At the cutting station 23, a leading edge region of the web 22 is cut to form an inner frame F to be applied to each wrapped charge C of cigarettes S. The inner packaging frame F is designed to lend additional dimensional stability to each charge C and also forms a structural part of the pack P to be produced, in particular to provide a male structural support for closing the lid. When it is cut from the web 22, the inner frame F is generally flat but it typically includes at least a front panel $F_1$ and two side flaps $F_2$, such that the frame F is applied to a charge C of cigarettes by folding the inner frame to at least partially encompass that charge C. As is seen in FIG. 1, folding of an inner frame F and application of that frame to a respective charge C of cigarettes takes place in a carousel 24 arranged downstream of the cutting station 23. The discrete charges C are delivered to the carousel 24 via the carousel 16 of the sub-system 10 to be combined with a respective inner frame F. The frame applying carousel 24 then conveys the charges C of cigarettes to a next sub-system 30 of the packaging system.

The sub-system 30 includes stacks 31 of packaging blanks B which are conveyed individually along a conveyor belt 32 and quality checked (e.g. via optical sensors) before being fed or delivered via rollers 33 to a blank assembly carousel 34. Each of the packaging blanks B is typically formed of card or paper-board or the like and is configured having a series of panels, flaps, and fold- or score-lines for assembly (e.g. by folding and/or optionally adhesive bonding) into a generally rectangular cigarette box, of a shape known in the art. The charges C of cigarettes S having the frame F attached to them are sequentially delivered to the blank assembly carousel 34 by the carousel 24 of the sub-system 20, where each charge C is combined with a respective one of the packaging blanks B. As the charge C of cigarettes and associated blank B progress around the carousel 34, the blank B is progressively folded and assembled around the wrapped charge C. As the blank B is assembled, it combines with the inner frame F to form the pack P enclosing the charges C of cigarettes S. The packs P are then delivered via a further carousel 35 from the blank assembly carousel 34 to a further sub-system 40. This sub-system 40 includes a pack buffer 41 in which the packs P accumulate and are held temporarily as they progress via a handling and/or inspection station 42 to a conveyor 43 for delivery to a final wrapping station (not shown).

Figure 2:
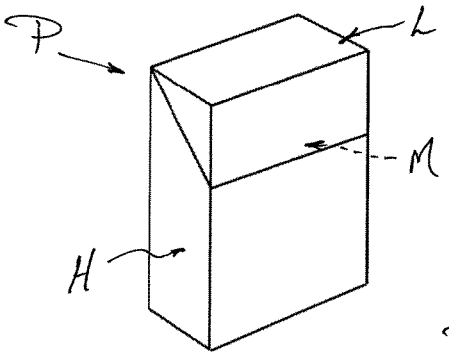
FIG. 2 is a perspective view of a pack of cigarettes according to one embodiment produced by a process according to an embodiment of this invention, shown with the lid in the closed position.
Figure 3:
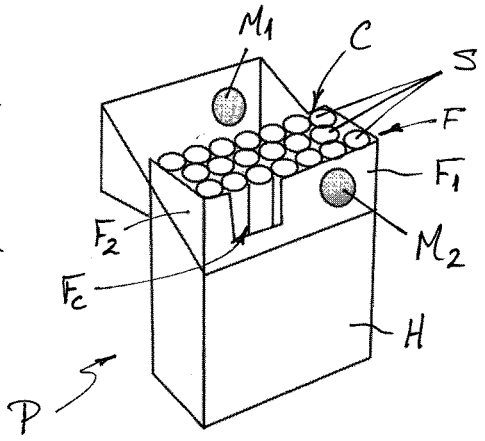
FIG. 3 is a perspective view of the pack of cigarettes in FIG. 2, with the lid in an open position.
Figure 4:
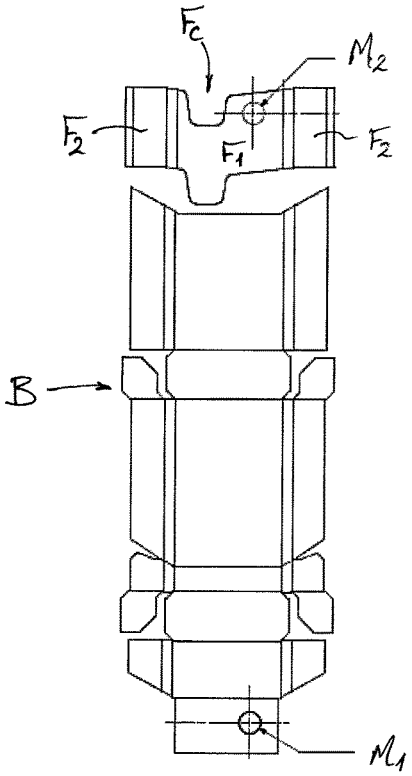
FIG. 4 is a plan view of a packaging blank and a frame for the pack of cigarettes in FIG. 2 and FIG. 3.

With reference now to FIGS. 2 to 4 of the drawings, a pack P of cigarettes S produced according to an embodiment of the invention and a corresponding packaging blank B and frame F for such an embodiment are illustrated. The assembled pack P can be seen in FIGS. 2 and 3 to include a container portion H for holding the charge C of cigarettes S, a lid L which has a hinge-type connection to the container portion H and is able to be moved or pivoted between a closed position (as shown in FIG. 2) preventing access to the smoking articles S in the container portion H and an open position (as shown in FIG. 3) for accessing the smoking articles S. Furthermore, the pack P includes a magnetic closure M having a first magnetic closure element $M_1$ and a second magnetic closure element $M_2$ which are configured and arranged to exert a magnetic force, one with respect to the other, for holding the lid L in the closed position. As is apparent from FIG. 2, this embodiment is such that the pack P has a generally cuboid shape with a flip-top box format shown with the lid L in the closed position. As is apparent from FIG. 3, the first magnetic closure element $M_1$ is incorporated at a front inner face of the lid L of the pack P. The second magnetic closure element $M_2$, on the other hand, is provided in or on a front face of the container portion H positioned to be directly adjacent and aligned with the first magnetic closure element $M_1$ when the lid is in the closed position. In this way, a magnetic force of attraction between the first and second elements $M_1$, $M_2$ of the magnetic closure M provides a distinct and secure engagement between the lid L and the container portion H of the pack P when the lid L closes. As can be seen in FIG. 4, the first magnetic closure element $M_1$ is incorporated in a flap of the packaging blank B which is folded to form the inner face of the lid L as the blank B is assembled to form the pack P on the carousel 34. The second magnetic closure element $M_2$ is provided or placed onto the first magnetic closure element $M_1$ on the packaging blank B, where it is held temporarily during pack production by force of magnetic attraction. During assembly of the blank B in the carousel 34, the inner frame F combines with the blank B to form part of the container portion H of the pack P, and more specifically an upper front part of the container portion H including a cut-out $F_C$ for easier access to the cigarettes S when the lid L is open. As the blank B is assembled in the carousel 34, the second magnetic closure element $M_2$ which is temporarily held and localised on the first magnetic closure element $M_1$ is adhesively affixed or bonded to the inner frame F at the position marked in FIG. 4 in broken lines.

In this embodiment of FIGS. 2 to 4, the first magnetic closure element $M_1$ may already be incorporated in each of the packaging blanks B provided in the stacks 31 of sub-system 30 for delivery to the assembly carousel 34. In order that the first magnetic closure elements $M_1$ of the stacked blanks B do not interact with one another and disrupt individual handling of the packaging blanks B in the sub-system 30, each first magnetic closure element $M_1$ may comprise a ferrous metal disc having a diameter of about 10 mm and a thickness of 0.5 mm or less. That disc $M_1$ may be adhesively bonded to the lid flap of the packaging blank B; for example, during production of the blank B. The second magnetic closure element $M_2$, on the other hand, may comprise a small permanent magnet, e.g. a neodymium magnet, again formed as a thin circular disc with a diameter of about 10 mm and thickness of about 0.5 mm, which may be individually applied onto each respective first magnetic closure element $M_1$ as or after it is delivered to the assembly carousel 34 by the conveyor 32 and/or rollers 33 of the subsystem 30. Thus, each disc-shaped permanent magnet element $M_2$ may be held in position on a complementary ferrous metal disc element $M_1$ of the blank B, until it is adhesively bonded to the frame F in the sub-system 30. Alternatively, it is also possible that the first magnetic closure element $M_1$ incorporated in each of the packaging blanks B is a permanent magnet and the blanks B are simply handled in a manner within the sub-system 30 to avoid magnets $M_1$ of neighbouring blanks from negatively interfering with one another as they move in the system 100. In that case, the second closure element $M_2$ which is applied to or placed on the first magnetic closure element $M_1$, e.g. upstream of or in the carousel 34, may be in the form of a thin ferrous metal disc (or other magnetically sensitive material), or itself a second permanent magnet.

With reference to FIG. 1A, each second magnetic closure element $M_2$ may be applied or deposited onto a respective first magnetic element $M_1$ by means of a pick-and-place sub-system 50 as each blank B carrying the first magnetic closure element $M_1$ is transferred towards carousel 34 to be assembled by folding and bonding in the sub-system 30. Alternatively, both of the first and second magnetic closure elements $M_1$, $M_2$ may be applied or deposited to the individual blanks B in a combined state. That is, the first and second elements $M_1$, $M_2$ may be held together in magnetic attraction and deposited or applied to the blanks B by means of the same pick-and-place sub-system 50. In so doing, the first element $M_1$ in contact with the blank B may be adhesively bonded thereto with the second element $M_2$ being held in place by magnetic attraction. To this end, adhesive is advantageously applied either to the blank B and/or the first magnetic element $M_1$ itself. In such embodiments, therefore, the magnetic closure elements $M_1$, $M_2$ can be processed from a supply in the sub-system 50 either individually or in a combined state by an automated transfer means, such as a multiple axis arm or the like, as known to be used in pick-and-place systems, e.g. in the electronics industry.

In an alternative embodiment of the process, it will be noted that the first and second magnetic closure elements $M_1$, $M_2$ in the pack of FIGS. 2 to 4 may be introduced to the packaging material in combination on the inner frame F; e.g. at the cutting station 23 or downstream thereof by means of a second pick-place sub-system 60, as represented in FIG. 1A. This second pick-and-place subsystem is advantageously similar, if not identical, in structure and function as the sub-system 50 described above. In this case, the first magnetic closure elements $M_1$ could be affixed or bonded to the front frame panel $F_1$ with the second magnetic closure element $M_2$ held temporarily in position on the first closure element $M_1$ for transfer to and bonding with the inner face of the lid L during assembly of the blank B in the carousel 34. That is, the blank B is folded and/or bonded in the carousel 34 around the charge C of smoking articles S equipped with or carrying the inner frame F thereon according to standard manufacturing processes.

As noted above, the adhesive attachment or bonding of the first and second magnetic closure elements $M_1$, $M_2$ to the respective packaging blank B and inner frame F may involve the administration of an adhesive, e.g. in liquid form, to the blank B and inner frame F followed by the application of the magnetic closure elements $M_1$, $M_2$ (e.g. as a permanent magnet or a metal disc) thereto. As an alternative, however, either or both the first and second magnetic closure elements $M_1$, $M_2$ may be provided with an adhesive substrate, such as an adhesive label, which can simply be applied (e.g. with pressure) and "stuck" onto the respective blank B and frame F. For example, the magnetic closure element $M_2$ could be quickly and simply applied to a face of the inner frame F via activation of an adhesive label or substrate and pressing same against that face of the inner frame F as the blank is assembled. The blank B and frame F to which each of the first and second magnetic closure elements $M_1$, $M_2$ are fixed or bonded may optionally include a recess R within which a respective one of the closure elements $M_1$, $M_2$ is received and accommodated. The recess R may comprise an opening or hole which extends through the blank B or frame F, such that the magnetic closure element $M_1$, $M_2$ is received snugly within the opening and an adhesive label extending beyond a periphery of that magnetic closure element $M_1$, $M_2$ adheres to a region of the blank B or frame F surrounding the opening or hole.

Figure 1B:
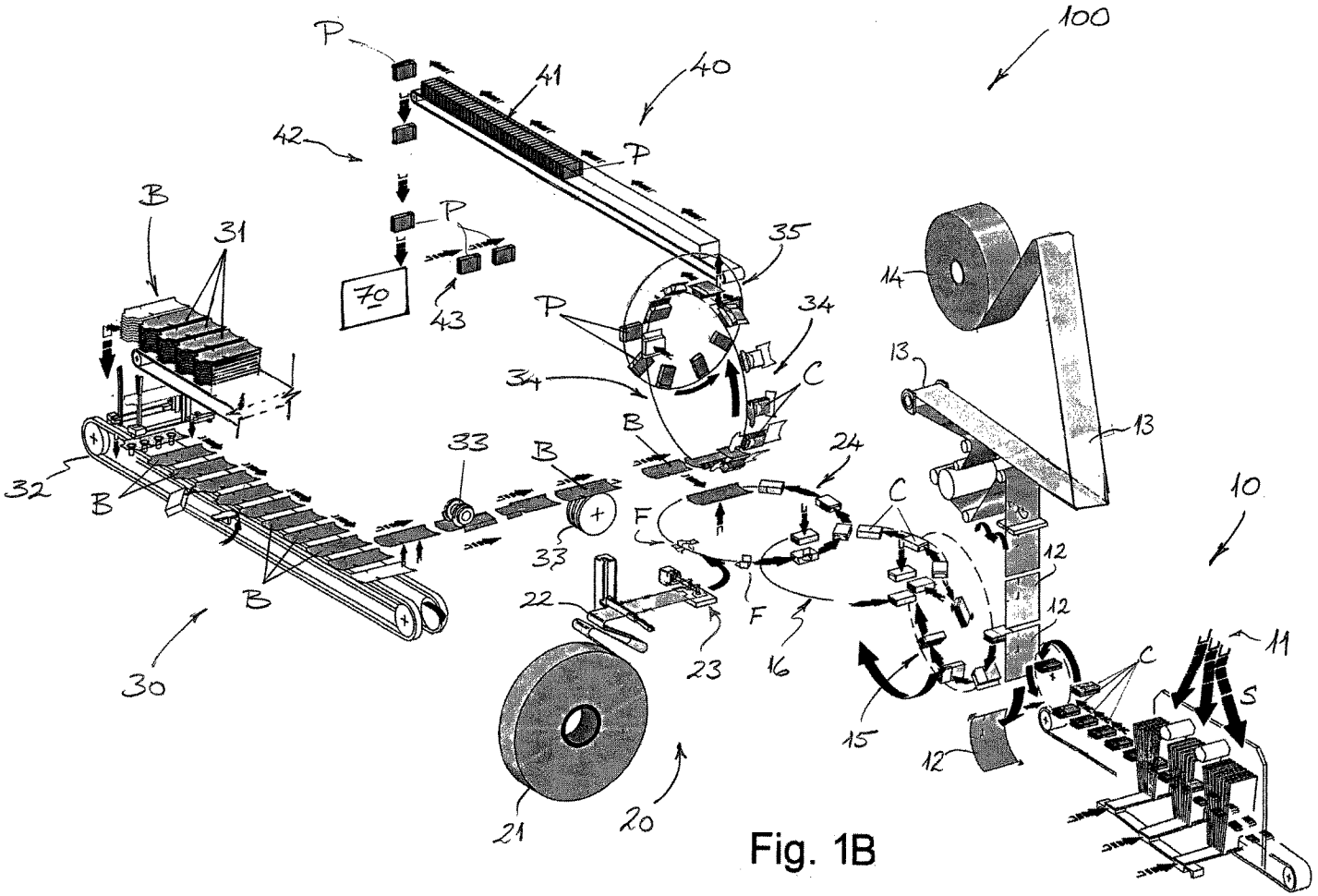
FIG. 1B is a schematic perspective view of a packaging system for use in carrying out a process for producing a pack of smoking articles according to another embodiment of this invention.

In a further alternative embodiment of the process which is represented in FIG. 1B, it will be noted that the first and second magnetic closure elements $M_1$, $M_2$ in the pack P of FIGS. 2 to 4 may be applied and affixed to the inner face of the lid L and the front face of the container portion H, respectively, after the blank B has been fully assembled to form the pack P around the charge of smoking articles S. In such an embodiment, each of the packs P is produced as if it were not to include a magnetic closure M, i.e. like a regular flip-top box smoking article package. This provides the key advantage that no change is required to existing packaging lines to add pick and place sub-systems like sub-systems 50, 60 in the packaging line of FIG. 1A. As a result, there is no reduction in the production speeds and undesired interaction between individual magnetic closure elements $M_1$, $M_2$ and other parts of the system 100 (e.g. during folding of the blanks B and frames F) can be avoided.

According to the invention as represented in FIG. 1B, packs P issuing from the buffer 41 along the inspection or handling station 42 may be processed by a stand-alone sub-system 70, which may be retro-fitted to the packaging system 100. The sub-system 70 may comprises means for opening and closing the lid L of the packs P and a pick-and-place device (not shown) configured to insert the first and second magnetic closure elements $M_1$, $M_2$ together or in combination and bond same within the pack P, before reclosing the lid and further transferring the pack P with conveyor 43 for it to be wrapped in a protective sealing film. Again in this embodiment, the use of an adhesive substrate or label to effect a rapid connection of the magnetic closure elements $M_1$, $M_2$ to the specific parts of the packaging material may be advantageous.

Figure 5:
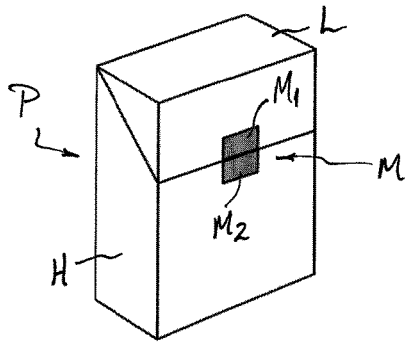
FIG. 5 is a perspective view of a pack of cigarettes according to another embodiment and produced by a process according to another embodiment of this invention, with the lid in the closed position.
Figure 6:
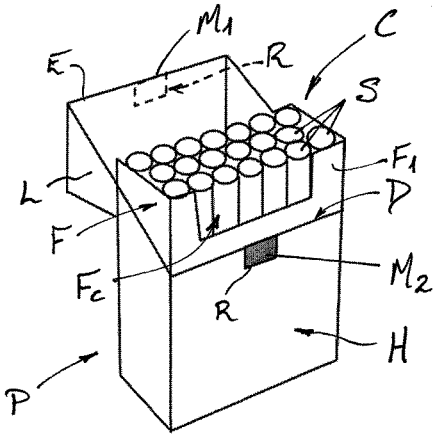
FIG. 6 is a perspective view of the pack of cigarettes in FIG. 5, with the lid in an open position.

Referring now to FIG. 5 and FIG. 6 of the drawings, a pack P of cigarettes S produced according to another embodiment of the invention is illustrated. Again, the assembled pack P is seen to include a container portion H for holding a charge C of cigarettes S, a lid L which is hinge connected to the container portion H for pivoting movement between a closed position (shown in FIG. 5) preventing access to the smoking articles S in the container portion H and an open position for accessing the smoking articles S (as shown in FIG. 6). Further, the pack P again includes a magnetic closure M with first and second magnetic closure elements $M_1$, $M_2$ configured and arranged to exert a magnetic force, one with respect to the other, for holding the lid L in the closed position. In this embodiment, both of the first and second magnetic closure elements $M_1$, $M_2$ are small rectangular elements and both are visible when the lid L is in the closed position, as seen in FIG. 5. The first magnetic closure element $M_1$ is located at an edge region E of the lid L and the second magnetic closure element $M_2$ is set at a corresponding abutment edge D of the container portion H of the pack P, e.g. fixed between a front panel of the blank B and the inner frame F.

The pack P of FIGS. 5 and 6 is desirably produced according to the process described with reference to FIG. 1B, with the magnetic elements $M_1$, $M_2$ introduced in corresponding recesses R formed at a front edge region E or front panel $L_F$ of the lid L and at abutment edge D the container portion H of each pack P after completion of the folding and assembly of the blanks B. As in the previous embodiment, one of the first and second magnetic closure elements $M_1$, $M_2$ may be a permanent magnet and the other may be a ferrous metal or some other magnetically sensitive material, or both could be permanent magnets. In this case, both of the first and second magnetic closure elements $M_1$, $M_2$ may be introduced together or in a combined state after assembly of the packaging blanks B in the carousel 34. In particular, the combined first and second closure elements $M_1$, $M_2$ could be applied to each pack P as it progresses from the buffer 41 via the handling or inspection station 42. To this end, the stand-alone sub-system 70 as represented in FIG. 1B comprises at least one pick-and-place device (not shown) which may insert and bond the combined first and second magnetic closure elements $M_1$, $M_2$ within the pack P, before the pack P is transferred via the conveyor 43 for wrapping the pack in a protective sealing film. The means of attaching these magnetic closure elements $M_1$, $M_2$ in the pack P of FIGS. 5 and 6 may be as for the pack P of FIGS. 2 to 4, i.e. via an adhesive and/or a substrate or label.

Figure 7:
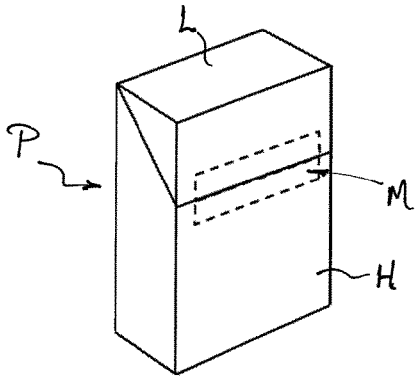
FIG. 7 is a perspective view of a pack of cigarettes according to a further embodiment and produced by a process according to a further embodiment of the invention, with the lid in a closed position.
Figure 8:
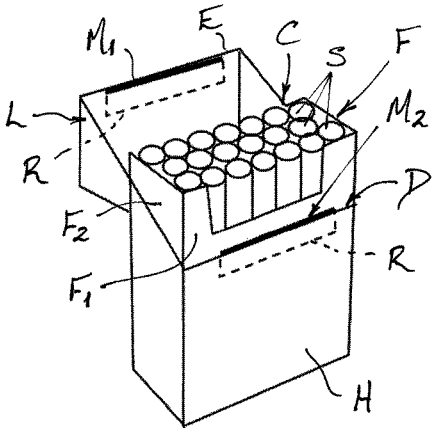
FIG. 8 is a perspective view of the pack of cigarettes in FIG. 7, with the lid in an open position.

With reference to FIG. 7 and FIG. 8 of the drawings, a pack P of cigarettes S produced according to a further embodiment of the invention is illustrated. The position of the first and second magnetic closure elements $M_1$, $M_2$ in this embodiment is similar to the arrangement in FIGS. 5 and 6 but the first and second closure elements $M_1$, $M_2$ in this case are elongate and strip-like elements instead of rectangular, e.g. a permanent magnet strip or a metal strip. Nevertheless, the magnetic closure M is located along the lower edge region E of lid L, with the closure elements preferably introduced or applied via a process as represented in FIG. 1B. These strip-like closure elements $M_1$, $M_2$ are preferably affixed in the pack P via an adhesive carrier substrate or label.

Figure 9:
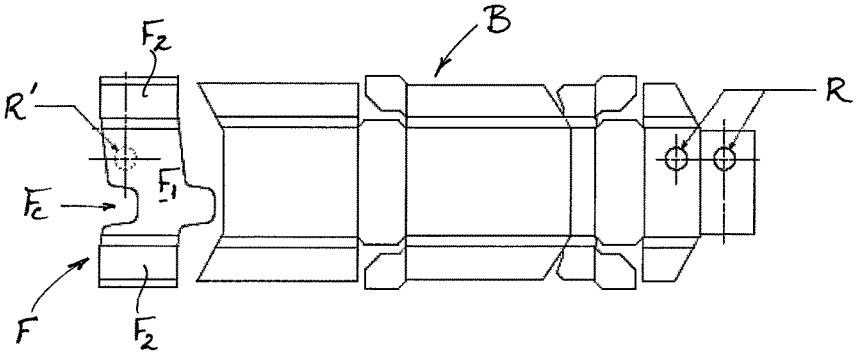
FIG. 9 is a plan view of an alternative packaging blank and frame for a pack according to FIGS. 2 and 3.

Referring now to FIG. 9 of the drawings, another embodiment of the process for forming a pack as shown in FIGS. 2 to 4 may be carried out via the system 100 of FIG. 1B. The first and second magnetic closure elements $M_1$, $M_2$ in the pack P are applied and affixed to the inner face of the lid L and the front face of the container portion H, respectively, after the blank B has been assembled to form the pack P. As is seen in FIG. 9, flaps of the packaging blank B which form a front part of the lid L as the blank B is assembled to form the pack P on the carousel 34 include aligned apertures or recesses R. Also, a corresponding circular area R' (in broken lines) is shown on a middle panel $F_1$ of the inner frame F. This circular area R' is in alignment with the apertures or recesses R after the pack P has been assembled and the lid L is in the closed position. More particularly, during assembly of the blank B in the carousel 34, the inner frame F combines with the blank B to form part of the container portion H of the pack P; specifically an upper front part of the container portion H including a cut-out $F_C$ for easier access to the cigarettes S in the pack when the lid L is open. Thus, after assembly of the blank B, the pack P includes the apertures R which extend through the front of the lid L in alignment with the area R' on the frame F. When the packs P progress from the buffer 41 through the handling station 42, a robotic arm of a pick-and-place device (not shown) in the sub-system 70 introduces or applies the first and second magnetic closure elements $M_1$, $M_2$ to each pack P while these elements $M_1$, $M_2$ are held together in a combined state. Furthermore, each of the magnetic closure elements $M_1$, $M_2$ is individually fixed or bonded to the packaging material of that pack P, before each pack P is then wrapped in a protective film.

In this embodiment, each first magnetic closure element $M_1$ is preferably a ferrous metal disc with diameter of about 10 mm and a thickness of about 0.5 mm or less. Each second magnetic closure element $M_2$, on the other hand, may comprise a small permanent magnet, e.g. a neodymium magnet, again shaped as a thin circular disc having a diameter of about 10 mm and a thickness of about 0.5 mm. Each of the first magnetic closure elements $M_1$ is individually combined with a respective second magnetic closure element $M_2$ before they are together taken by the pick-and-place device (not shown) of the sub-system 70 in FIG. 1B. Thus, the ferrous metal disc element $M_1$ is held in place on complementary disc-shaped permanent magnet element $M_2$. Alternatively, it is possible that the first magnetic closure element $M_1$ is also a permanent magnet. In that case, the second closure element $M_2$ that is placed on or combined with the first magnetic closure element $M_1$ may remain a permanent magnet, or alternatively may be a thin disc of ferrous metal or other magnetically sensitive material. When placed in face-to-face contact with one another, the magnetic force exerted by one of the closure elements $M_1$, $M_2$ with respect to the other holds those disc-shaped closure elements $M_1$, $M_2$ together in a combined state.

The apertures R formed through the lid L of the pack P are sized slightly larger than the disc-shaped first and second magnetic closure elements $M_1$, $M_2$. The first magnetic closure element $M_1$ is provided on a carrier substrate or layer, which extends considerably beyond a periphery of that first disc-shaped element $M_1$ and preferably has a rectangular geometry corresponding to a front face or panel $L_F$ of the lid L. While the disc-shaped second magnetic closure element $M_2$ may also include a carrier substrate, this does not extend beyond the circular periphery of that disc-shaped element $M_2$. Therefore, when the magnetic closure elements $M_1$, $M_2$ are introduced and applied to the pack P, the pick-and-place device takes these closure elements $M_1$, $M_2$ held together by magnetic attraction and inserts them into the apertures R in the front face $L_F$ of the lid L such that the disc-shaped second element $M_2$ enters through the apertures R first and passes through into contact with the frame F at the position of the circular area R'. By pre-applying an adhesive to the circular area R' and/or to a carrier substrate of the disc-shaped second element $M_2$, that second magnetic closure element $M_2$ is then adhesively bonded to the frame F in the circular area R'. As the second closure element $M_2$ is pressed against the frame F, the disc-shaped first closure element $M_1$ is also received in the apertures R in the front face $L_F$ of the lid L. At this point, the carrier substrate or layer on the first closure element $M_1$ having the rectangular geometry corresponding to the front face $L_F$ of the lid L makes contact with and is adhered or bonded to that front face $L_F$ of the lid L. In particular, by pre-applying an adhesive to the front face $L_F$ of the lid L and/or to the rectangular carrier substrate (e.g. as an adhesive label), the first magnetic closure element $M_2$ is adhesively bonded to the lid L accommodated within the aperture or recess R. The use of an adhesive substrate or label in this embodiment can be advantageous to effect a rapid connection of the magnetic closure elements $M_1$, $M_2$ to the packaging material of pack P. An advantage of this technique for affixing the elements $M_1$, $M_2$ of the magnetic closure M via the apertures R is that the lid L of the pack P does not need to be opened after assembly of the packaging blank B.

Although specific embodiments of the invention have been illustrated and described herein, it will be appreciated by those of ordinary skill in the art that a variety of alternate and/or equivalent implementations exist. It should be appreciated that the exemplary embodiment or exemplary embodiments are only examples, and are not intended to limit the scope, applicability, or configuration in any way.

Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents. Generally, this application is intended to cover any adaptations or variations of the specific embodiments discussed herein.

Also, it will be appreciated that in this document, the terms "comprise", "comprising", "include", "including", "contain", "containing", "have", "having", and any variations thereof, are intended to be understood in an inclusive (i.e. non-exclusive) sense, such that the process, method, device, apparatus or system described herein is not limited to those features or parts or elements or steps recited but may include other elements, features, parts or steps not expressly listed or inherent to such process, method, article, or apparatus. Furthermore, the terms "a" and "an" used herein are intended to be understood as meaning one or more unless explicitly stated otherwise. Moreover, the terms "first", "second", "third", etc. are used merely as labels, and are not intended to impose numerical requirements on or to establish a certain ranking of importance of their objects.

LIST OF REFERENCE SIGNS

100 packaging system
10 sub-system
11 buffer or hopper
12 rectangular sheet
13 web
14 roll
15 carousel
16 carousel
20 sub-system
21 roll
22 web
23 cutting station
24 carousel
30 sub-system
31 stack
32 conveyor belt
33 roller
34 blank assembly carousel
35 carousel
40 sub-system
41 pack buffer
42 handling and/or inspection station
43 conveyor
50 sub-system
60 sub-system
70 sub-system
S smoking article or cigarette
C charge of smoking articles or cigarettes
P pack
F packaging frame or inner frame
$F_1$ front panel
$F_2$ side flap
$F_C$ cut-out
B packaging blank
M magnetic closure
$M_1$ first magnetic closure element
$M_2$ second magnetic closure element
H container portion
L lid
$L_F$ front face or panel of the lid
E edge region
D abutment edge
R recess or aperture
R' circular area

The invention claimed is:

1. A production process for producing a pack of smoking articles, the process comprising:

assembling packaging material around a charge of smoking articles to form a pack enclosing the charge of smoking articles, wherein the assembled pack includes a container portion to hold the charge of smoking articles, a lid that is movable between a closed position for preventing access to the smoking articles in the container portion and an open position for accessing the smoking articles, and a magnetic closure having a first magnetic closure element and a second magnetic closure element which are configured and arranged to exert a magnetic force for holding the lid in the closed position;

introducing the first magnetic closure element into or onto the packaging material;

positioning the second magnetic closure element on the first magnetic closure element already applied to the packaging material after the step of introducing the first magnetic closure element, whereby the first and second magnetic closure elements are combined; and introducing the second magnetic closure element into or onto the packaging material after the step of positioning the second magnetic closure element.

2. A process according to claim 1, wherein the first and second magnetic closure elements are held together or combined with one another by magnetic attraction.

3. A process according to claim 1, further comprising affixing or attaching each of the first and second magnetic closure elements to different parts of the packaging material, wherein the magnetic closure elements are positioned to substantially align with and/or contact one another when the lid is in the closed position.

4. A process according to claim 3, wherein the step of affixing or attaching the second magnetic closure element to the packaging material is performed as or while the second magnetic closure element is magnetically held together or combined with the first magnetic closure element.

5. A process according to claim 1, wherein the first and second magnetic closure elements are introduced into or onto the packaging material prior to assembling a packaging blank of the packaging material around the charge of smoking articles.

6. A process according to claim 1, wherein the packaging material includes a packaging blank and a frame that is wrapped or folded around the charge of smoking articles prior to combining the charge of smoking articles with the packaging blank, wherein the first and second magnetic closure elements are applied or introduced into or onto the frame.

7. A process according to claim 1, wherein the first and second magnetic closure elements are introduced into the packaging material forming the pack after the step of assembling a packaging blank of the packaging material around the charge of smoking articles.

8. A process according to claim 7, further comprising opening the pack and introducing or applying the first and second magnetic closure elements to a part of the container portion or the lid, and closing the lid after introduction of the magnetic closure elements.

9. A process according to claim 1, wherein one of the first and second magnetic closure elements is affixed or bonded to a part of the packaging material that forms the lid of the pack, and the other of the first and second magnetic closure elements is affixed or bonded to a part of the packaging material that forms the container portion of the pack.

10. A process according to claim 9, wherein each of the first and second magnetic closure elements is bonded to the packaging material with a bonding strength greater than a maximum magnetic force capable of being exerted between the first and second magnetic closure elements.

11. A process according to claim 1, wherein at least one of the first and second magnetic closure elements is received and accommodated in a respective recess provided in the packaging material.

12. A process according to claim 11, wherein the recess is provided in part of a packaging blank of the packaging material, the container portion, the lid, and/or a frame of the packaging material.

13. A process according to claim 1, wherein the first and second magnetic closure elements are affixed or bonded to the packaging material via a carrier substrate.

14. A process according to claim 13, wherein the carrier substrate is a label.

15. A process according to claim 1, wherein one of the first and second magnetic closure elements is a permanent magnet and the other of the first and second magnetic closure elements is comprised of a material that reacts to a magnetic field generated by the permanent magnet; or wherein both of the first and second magnetic closure elements comprise a permanent magnet.

16. A process according to claim 15, wherein the material that reacts to a magnetic field generated by the permanent magnet is a ferrous metal.

17. A process according to claim 1, wherein both of the first and second magnetic closure elements are received and accommodated in a respective recess provided in the packaging material.

18. A process according to claim 17, wherein the respective recesses are provided in part of a packaging blank of the packaging material, the container portion, the lid and/or a frame of the packaging material.

19. A production process for producing a pack of smoking articles, the process comprising:

assembling packaging material around a charge of smoking articles to form a pack enclosing the charge of smoking articles;

wherein the assembled pack includes a container portion to hold the charge of smoking articles, a lid that is movable between a closed position for preventing access to the smoking articles in the container portion and an open position for accessing the smoking articles, and a magnetic closure having a first magnetic closure element and a second magnetic closure element which are configured and arranged to exert a magnetic force for holding the lid in the closed position;

wherein the process includes placing the first and second magnetic closure elements together or in combination with one another in the packaging material that forms the pack, wherein the first magnetic closure element is introduced into or onto the packaging material, and wherein the second magnetic closure element is then subsequently positioned on the first magnetic closure element already applied to the packaging material, whereby the first and second magnetic closure elements are combined, wherein the packaging material includes a packaging blank and a frame that is wrapped or folded around the charge of smoking articles prior to combining the charge of smoking articles with the packaging blank, wherein the first and second magnetic closure elements are applied or introduced into or onto the frame, and wherein the first and second magnetic closure elements are applied or introduced into or onto the frame at a position opposite an inner face of the lid in the closed position.

20. A production process for producing a pack of smoking articles, the process comprising:

assembling packaging material around a charge of smoking articles to form a pack enclosing the charge of smoking articles, wherein the packaging material includes a packaging blank and a frame that is wrapped or folded around the charge of smoking articles prior to combining the charge of smoking articles with the packaging blank, wherein the assembled pack includes a container portion to hold the charge of smoking articles, a lid that is movable between a closed position for preventing access to the smoking articles in the container portion and an open position for accessing the smoking articles, and a magnetic closure having a first magnetic closure element and a second magnetic closure element which are configured and arranged to exert a magnetic force for holding the lid in the closed position;

placing the first and second magnetic closure elements together or in combination with one another in the packaging material that forms the pack; and applying or introducing the first and second magnetic closure elements into or onto the frame at a position opposite an inner face of the lid in the closed position.

* * * * *